United States Patent [19]

Kruit et al.

[11] Patent Number: 4,919,273

[45] Date of Patent: Apr. 24, 1990

[54] APPARATUS FOR SORTING METAL BARS BY LENGTH

[75] Inventors: Jan Kruit, Slootdorp; Joannes W. J. Knapen, Utrecht, both of Netherlands

[73] Assignee: Hoogovens Groep B.V., Ijmuiden, Netherlands

[21] Appl. No.: 306,166

[22] Filed: Feb. 6, 1989

[30] Foreign Application Priority Data

Feb. 19, 1988 [NL] Netherlands ..... 8800425

[51] Int. Cl.[5] ..... B07C 5/14

[52] U.S. Cl. ..... 209/517; 209/521; 209/695

[58] Field of Search ..... 209/517, 521, 656, 658, 209/695, 617

[56] References Cited

U.S. PATENT DOCUMENTS

| | | | |
|---|---|---|---|
| 996,386 | 6/1911 | Williams | 209/521 |
| 2,852,136 | 9/1958 | Peck | 209/521 |
| 2,901,106 | 8/1959 | Aitken | 209/517 |
| 3,368,700 | 2/1968 | Tarrant | 209/521 |
| 3,557,952 | 1/1971 | Heikinheimo | 209/517 |
| 3,923,157 | 12/1975 | Cavenar | 209/517 |

FOREIGN PATENT DOCUMENTS

| | | | |
|---|---|---|---|
| 4978 | 1/1978 | Japan | 209/517 |
| 6702311 | 8/1967 | Netherlands . | |

*Primary Examiner*—Donald T. Hajec

*Attorney, Agent, or Firm*—Stevens, Davis, Miller & Mosher

[57] ABSTRACT

Apparatus for sorting metal bars by length, has a conveyor on which the bars are arranged longitudinally and conveys the bars both longitudinally and laterally. The conveyor has driven rollers contacted by the bars. A pick-up device picks up and conveys laterally, with respect to the conveyor, ends of bars having a predetermined length, thus preventing the longitudinal movement of such bars while bars not of the predetermined length are conveyed longitudinally at least partly past the pick-up device by the conveyor. To avoid increase capacity of the apparatus, and avoid wear, the rollers are obliquely positioned rollers whose axis of rotation is at a non-zero angle to the lateral direction of the conveyor, these rollers being, over at least part of their axial lengths, circular cylindrical in shape.

10 Claims, 3 Drawing Sheets

APPARATUS FOR SORTING METAL BARS BY LENGTH

BACKGROUND OF THE INVENTION

1. Field of the Invention

The invention relates to an apparatus for sorting metal bars or other elongate articles by length.

2. Description of the Prior Art

An apparatus for sorting by length is known in the metallurgical industry where it is used for example for the sorting by length of reinforcing bars or concrete-reinforcing bars. One such apparatus, made by the firm Morgardshammer, will now be described. In the manufacture of concrete-reinforcing bars a billet of steel is rolled out into a bar from which a number of concrete-reinforcing bars of a desired length are obtained by cutting. In general the length of a billet rolled out into a bar is not a whole number multiple of the desired length of a bar so that a shorter residual part bar is produced. After the cutting station, the bars of desired length and the residual part bar come to the sorting apparatus and are laid on a lateral transfer device against a stop with their rearmost ends next to each other.

Of the bars of the desired length the other, foremost ends are also adjacent; the foremost end of the residual part bar lies longitudinally between the two ends of a bar of desired length.

The bars lying next to one another moved laterally towards a pick-up device and a conveyor which can move the bars both laterally and longitudinally. The foremost end of each bar of desired length extends far enough forward to be picked up by the pick-up device. The pick-up device is be provided with a chain which runs across a bridge which extends laterally over the conveyor. A carrier plate joined to the chain picks up the foremost end of a bar and conveys this laterally across the conveyor. This means that the carrier plate blocks the bar from moving longitudinally. The conveyor itself conveys the other part of the bar laterally.

In this way the apparatus conveys a bar of desired length laterally across the conveyor. Bars selected in this way are then packed into bundles and taken away.

The foremost end of a residual part bar does not extend to the pick-up device and so is not picked up by a carrier plate of the chain and is not prevented from moving in longitudinal direction when it reaches the conveyor. The conveyor conveys the residual part bar longitudinally forwards beneath the bridge extending over the conveyor. Simultaneously the conveyor moves the residual part bar laterally. As a result of these two movements the residual part bar is conveyed obliquely across the conveyor and is set down next to the conveyor but separated from the barss of desired length. The residual part bars are then carried off separately for further processing.

In this known apparatus the conveyor has rollers having grooves extending helically and alongside each other. The axis of rotation of each grooved roller extends in the lateral direction of the conveyor. The width of a groove is here equal to its pitch. A bar of desired length, of which an end part is picked up by the pick-up device and of which a part of the length rests on the grooved rollers, is blocked longitudinally by the pick-up device and conveyed in lateral direction by the flanks of the groove in which it is lying.

The entire length of a residual part bar rests on the conveyor and is not prevented from longitudinal movement. The grooved rollers convey the residual part bar longitudinally at a speed approximately corresponding to the peripheral velocity of the grooved roller and laterally at a speed which depends on the pitch of the helical grooves.

A drawback of the apparatus described above is that the sorting capacity of the apparatus and at the same time, therefore, the processing capacity of an entire rolling mill, is dependent on the cross-sectional size of the concrete reinforcing bar and is less for smaller cross-sections.

As described above, the manufacture of concrete-reinforcing bars starts from a billet which in principle is of fixed section and length, irrespective of the section of the bars to be manufactured from it. When billets of equal weight are rolled out into smaller section bars, the total length of bar produced is greater. After cutting of a rolled billet into bars of desired constant length, a billet rolled out further also produces more bars of that length. However, each groove in a grooved roller may hold only one bar, so that when the section of the bar is smaller, although per unit time an equal total length is sorted, per unit time a smaller total weight of bars is sorted. As a result of this only a smaller total weight of billets can be rolled out.

One reason why each groove in a grooved roller holds only one bar is as follows. If there is more than one bar in a groove, friction between the concrete bars may prevent a residual part bar from being conveyed in sufficient longitudinal direction, when the residual part bar is lying against a bar of desired length which is being blocked from longitudinal movement by the pick-up device. In particular with ribbed concrete-reinforcing bars, friction between bars can be very high.

Changing the grooved rollers of the conveyor in dependence on the section of the bars is not a practical solution. A conventional conveyor has about 40 grooved rollers in total. Changing and aligning such a large number of grooved rollers takes too much time.

Measured in weight sorted, the capacity of an apparatus for sorting by length provided with grooved rollers is for a diameter of the bars of 16 mm approximately 16% and for a diameter of the bars of 12 mm approximately 10%, when the sorting capacity for a diameter of the bars of 40 mm is taken as 100%.

Another drawback of an apparatus with a conveyor provided with grooved rollers is the high wear of the grooves. The lateral movement of bars on the conveyor is produced because a leading blank of a groove exerts a lateral force on a bar. It is always the same leading flank of a groove which exerts the lateral force; only the position on the leading flank is dependent on process parameters and diameter of the bar. As a result of this, locally high wear of this leading flank of the groove occurs. The other leading flank of the groove and the base of the groove play a subsidiary role in both the lateral transfer and the longitudinal transfer and scarcely wear.

A grooved roller of which a flank is worn must be filled in, re-ground or replaced. The additional drawback attached to this is that an apparatus with a conveyor provided with grooved rollers is costly to purchase and maintain.

Another drawback of an apparatus with a conveyor provided with grooved rollers is that the pitch fixes the relationship between lateral velocity and longitudinal velocity of a bar being conveyed. The peripheral velocity of the grooved rollers is bound by a practical maximum. The product of pitch and peripheral velocity defines the sorting capacity of the installation. Therefore, the fixed relationship between pitch and peripheral velocity sets a practical limit on the sorting capacity. At the same time, once the pitch of the grooves has been selected, it is no longer possible to influence the position where a residual part bar is set down. Also where grooved rollers are not ideally aligned together extra friction occurs with associated extra wear.

NL-A-88-00425 (GB-A-117364) shows a sorter for metal bars in which the bars are conveyed laterally by a conveyor. Bars having a predetermined minimum length are picked up at their ends and lifted by a worm onto a second lateral conveyor. Bars of lesser length are not picked up and do not reach the second conveyor, but fall down to be transported away.

SUMMARY OF THE INVENTION

The invention has the object of removing the drawbacks mentioned above. In accordance with the invention there is provided apparatus for sorting elongate articles by length, especially for the sorting of metal bars, comprising a conveyor having a longitudinal direction in which the bars are arranged and having means for conveying the bars both longitudinally and laterally which means comprise driven rollers contacted by the bars, and pick-up means for picking up and conveying laterally with respect to said conveyor, end s of bars having a predetermined length, thus preventing the longitudinal movement of such bars on the conveyor while bars not of said predetermined length are conveyed longitudinally at least partly past said pick-up means by said conveyor, characterized in that said rollers comprise a plurality of oblique rollers whose axis of rotation is at a non-zero angle to the lateral direction of the conveyor, said oblique rollers being, over at least part of their axial lengths, circular cylindrical in shape.

With such apparatus of the invention, it is possible to load a roller of the conveyor, and thereby the conveyor itself, over its full width in the lateral direction, and care only has to be taken that the individual concrete-reinforcing bars do not touch each other or only just touch each other over a limited part of their length. This creates the advantage that with a bar diameter of 16 mm, the sorting capacity increases from approximately 16% with the known apparatus to approximately 40% with the apparatus in accordance with the invention, the length-sorting capacity with a bar diameter of 40 mm being for both apparatuses taken as 100% With a bar diameter of 12 mm a corresponding increase from approximately 10% to approximately 30% occurs.

Another advantage of the apparatus of the invention is that the rollers are practically free from wear. Moreover, the circular cylindrical rollers are subject to even wear because the entire cylinder surface is used. This also means that wear has only a slight effect on the separating ability of a roller.

Yet another advantage is that the circular cylindrical rollers are inexpensive to purchase and maintain. Circular cylindrical rollers as such are known and available commercially as a standard item in many sizes. Grinding worn rollers is a simple and known process with circular cylindrical rollers.

It is remarked that obliquely arranged rollers are known for use in sorting timber by length, from US-A-2901106 but here in contrast to the present invention these roller cooperate with a pick-up device to remove the planks longer than a predetermined minimum.

Preferably the angle of the roller axis to the lateral direction is between 2° and 5° and more preferably is approximately 3.4°. Practical trials have shown that with an angle in this range adequate separation is obtained between a bar of the desired length and a residual part bar. Suitably this angle is adjustable, which means that it is possible to match the angle to the operating conditions of an individual roller or of a complete conveyor. This makes it possible to achieve an optimum sorting capacity over a very wide range of bar diameters.

Preferably at least one of the rollers is provided with means for braking a bar laterally and more preferably each alternate roller longitudinally is provided with such means for braking. As described above, in practice the still unsorted bars are often conveyed towards the pick-up device and the conveyor by means of a lateral transfer device. By providing such means for braking, it is possible to prevents a bar from moving uncontrolledly onto the conveyor in the lateral direction.

A simple and efficient means for braking comprises a helical rib on the cylinder surface of the roller. In practice it has been found that good results are obtained when the pitch of the rib is approximately 6 cm and the height of the rib approximately 0.5 cm. This rib preferably extends helically along the roller only at the initial end of the roller in the lateral transport direction, i.e. the end which first receives the bars.

Preferably the peripheral velocity of at least one of the rollers is individually adjustable. Suitably the peripheral velocity of the control roller is adjustable to a velocity of approximately 2.5 m/sec.

BRIEF DESCRIPTION OF THE DRAWINGS

An embodiment of the invention will be described below by way of non-limitative example with reference to in the drawings. In the drawings.

DESCRIPTION OF THE PREFERRED EMBODIMENT

Figure 1:
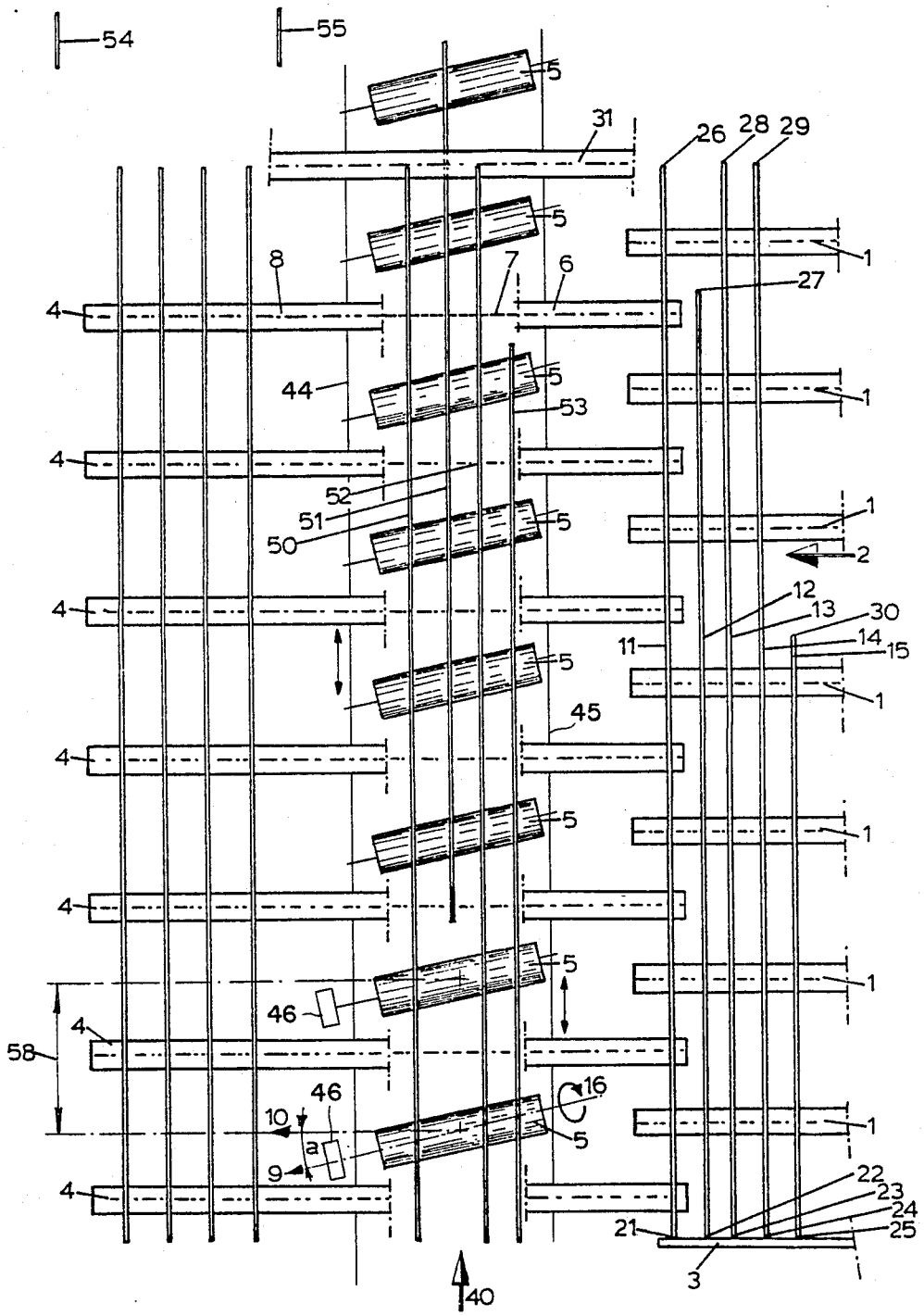
FIG. 1 is a schematic plan view of a part of an apparatus for sorting by length in accordance with the invention.

In FIG. 1, chain conveyors 1 together form a first lateral transfer device for lateral transfer of the concrete reinforcing bars 11,12,13,14,15 lying on it in the direction indicated by arrow 2.

The respective ends 21 to 25 of bars 11 to 15 are laid against stop 3 by a device not shown in the drawing. The opposite ends of the concrete-reinforcing bars 11 to 15 not abutting the stop 3 are indicated by 26 to 30 respectively.

The bars 11 to 15 are transferred by the first lateral transfer device towards a second lateral transfer device comprising chain conveyors 4.

Except for the foremost one, each chain conveyor 1 projects in between two chain conveyors 4 of the second lateral transfer device. In the overlapping part, chain conveyors 1 and 4 run at the same vertical height so that the bars 11 to 15 transfer smoothly from the first to the second lateral transfer device. Between the chain conveyors 4 and in front of the foremost chain conveyor 4 are located circular cylindrical rollers 5 forming a conveyor, which can move the bars both laterally and longitudinally. The direction of the rotational axis of each roller 5 indicated by arrow 9 forms (a) non-zero angle a with the lateral direction, indicated by arrow 10, of the second lateral transfer device. The angle (a) may be changed by movement of the supports 44, 45 for the axis of the rollers in the longitudinal direction of the rods.

The axis of each of the rollers 5 lies in the horizontal plane. The chain conveyors 4 run horizontally in the part indicated by 6 and at the same height as the chain conveyors 1 and at the same height as the topside of the rollers 5. The part 7 of the chain conveyors 4 runs below the underside of the rollers 5. The part 8 of the chain conveyors 4 runs horizontally again and at the same height as the topside of the rollers 5.

The rollers are rotated by conventional drive means 46 in the direction indicated by arrow 16.

A pick-up device 31 is positioned in front of the foremost roller 5. This pick-up device is not shown in further detail but may be the same as in the known sorting apparatus described above and may comprise a pick-up chain which runs as an arch across a bridge spanning over the conveyor. The chain is provided with pick-up elements for picking up and conveying in lateral direction an end part of a bar. Furthermore, the chain is provided with blocking means to block in the longitudinal direction indicated by arrow 40 an end part of a bar picked up by the pick-up device.

For the sake of clarity the concrete reinforcing bars 11 to 15 are drawn separated from one another. In practice the bars may lie touching one another. By giving the chain conveyors 4 a slightly higher speed than the chain conveyors 1, a small separation of the bars from one another takes place in the overlapping part of the two chain conveyors.

The bars which are now slightly separated from one another are carried towards the rollers 5 by means of the parts 6 of the chain conveyors 4. As a result of the angle (a) of the axis of the rollers 5, the bars are subjected by the rotating rollers to both a lateral force in the direction indicated by arrow 2 and to a longitudinal force in the direction indicated by arrow 40.

Figures 2, 3:
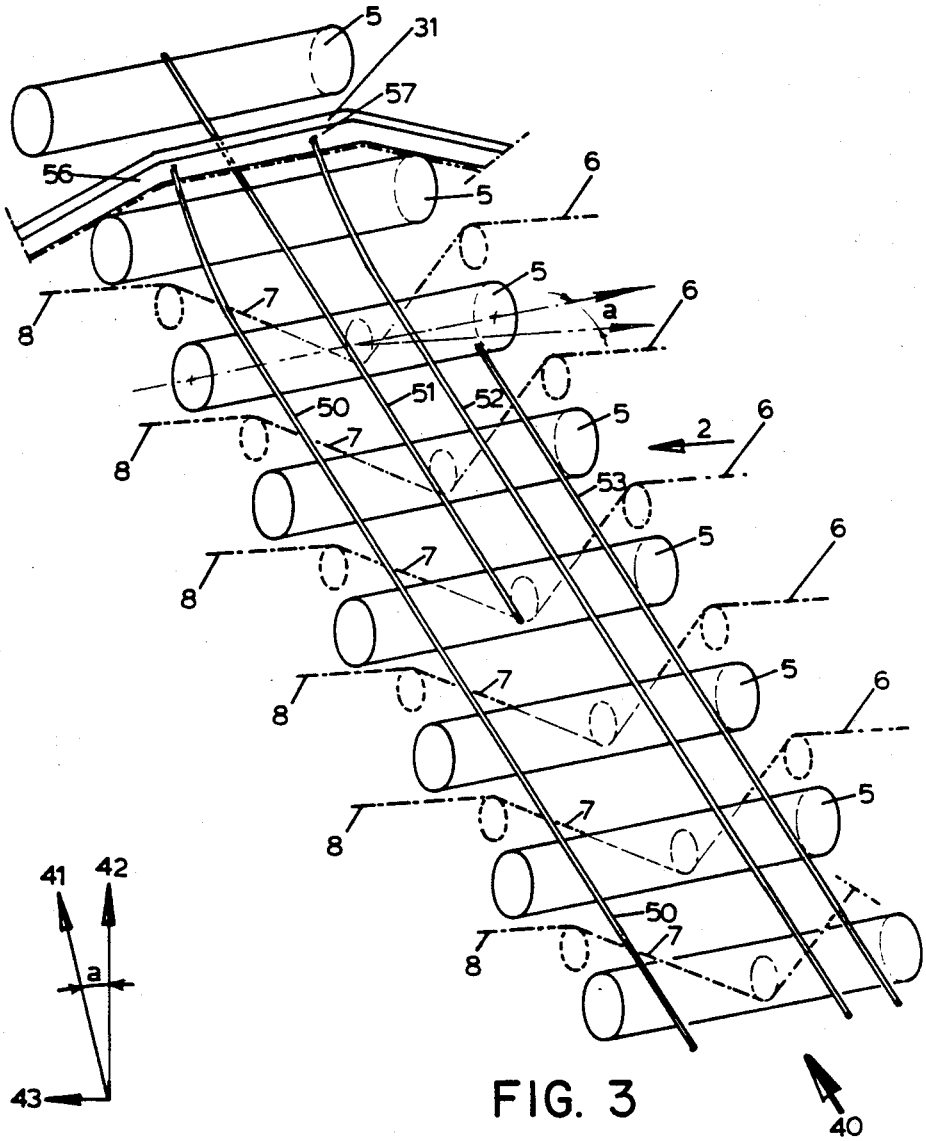
FIG. 2 is a vector diagram of the speed of a residual part bar in the apparatus of FIG. 1.
FIG. 3 is a schematic isometric view of a part of the apparatus of FIG. 1.

In the vector diagram of FIG. 2 the speed vector of a freely moving bar is indicated by arrow 41. This speed vector has a longitudinal direction component 42 and a lateral direction component 43. By suitable selection of the configuration of the conveyor and suitable selection of the rotation speed of the rollers 5 and the speed of the chain conveyors 4, the lateral velocity of the bar on the conveyor may be made equal to the lateral velocity of the second lateral transfer device.

Bars which are fed in by the chain conveyors 1 are conveyed by the parts 6 of the second lateral transfer device towards the conveyor with the rollers 5. Bars of the desired length, such as bars 50 and 52, are picked up by the pick-up elements of the transfer device 31 and blocked by its blocking means in the longitudinal direction 40. This means that these bars make only a lateral movement and come onto the part 8 of the second lateral transfer device, which part carries them further on towards an adjoining processing unit not shown in the drawing.

Shorter residual part bars, such as the bars 51 and 53 are not picked up by the transfer device 31 and are given both a longitudinal velocity as well as a lateral velocity by the rollers 5. As a result, these bar parts travel in the direction indicated by arrow 41 (FIG. 2). The residual bar parts then pass under the bridge of the transfer device 31. In FIG. 1 the residual bar part 51 has already partially passed the transfer device; residual bar part 53 is still lying in its original position in the longitudinal direction. The residual parts pass completely through the bridge, but because they also have a lateral velocity, they are separated from the bars of desired length and set down on the same side of the conveyor. 54 and 55 indicate two separated residual bar parts. The separated residual bar parts are carried off for further processing by a device not shown in the drawings.

FIG. 3 gives an isometric view of a part of the apparatus of FIG. 1. The same numbers from FIG. 1 indicate the corresponding elements in this figure. FIG. 3 shows that the transfer device 31 has picked up bars 50 and 52 by their forward ends 56 and 57, while these bars are still lying partially on the conveyor. The transfer device conveys the foremost part of these bars laterally. The residual bar part 51 has already partially passed under the bridge of the transfer device, and the residual bar part 53 is still lying in its original position in the longitudinal direction.

In this embodiment of the invention the diameter of the rollers 5 is 310 mm, the centre-to-centre distance 58 of the rollers 5 is 1500 mm, and the lateral velocity of the bars in operation is 0.15 m/sec, and the longitudinal velocity 2.55 m/sec. As indicated above, the angle a is 3.4°.

Figure 4:
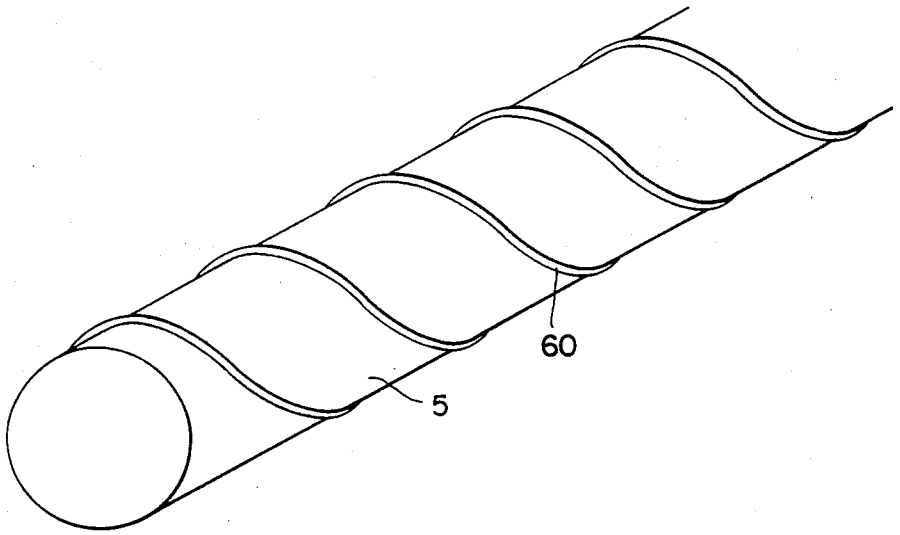
FIG. 4 is a perspective view of part of a roller having a helical rib, used in the apparatus of FIG. 1.

FIG. 4 shows a roller 5 having, as is preferred according to the invention, a helical rib 60, of pitch 5 cm and height 0.5 cm, on its cylindrical surface. This rib 60 acts as a braking means to stop the bars rolling along the roller 5, and is preferably present only at the end of the roller adjacent the second lateral transfer device 6.

What is claimed is:

1. Apparatus for sorting elongate bars having ends by length comprising (a) a conveyor having a longitudinal direction, the bars being arranged with their lengths parallel to the longitudinal direction, said conveyor defining means for conveying the bars both longitudinally and laterally and (b) pick-up means for picking up ones of said bars having a predetermined length, said pick-up means picking up said bars at their ends and conveying said bars laterally, with respect to their lengths, thus preventing the longitudinal movement of such bars on the conveyor while bars not of said predetermined length are conveyed longitudinally at least partly past said pick-up means by said conveyor means so as to sort them from said bars having the predetermined length, said conveyor means having rotatably driven rollers of predetermined length, said rollers obliquely positioned with respect to the longitudinal direction of said conveyor to be contacted by the bars, the axis of rotation of each of said driven rollers is at a non-zero angle to the lateral direction perpendicular to the longitudinal direction of the conveyor, said obliquely positioned rollers being, over at least part of their predetermined lengths, cylindrical in shape.

2. Apparatus in accordance with claim 1, wherein said non-zero angle is in the range 2° and 5°.

3. Apparatus in accordance with claim 2, wherein said non-zero angle is approximately 3.4°.

4. Apparatus in accordance with claim 1, including means to adjust said non-zero angle.

5. Apparatus in accordance with claim 1, wherein at least one of the rollers is provided with braking means for braking the bars in the lateral direction of the conveyor.

6. Apparatus in accordance with claim 5 wherein in the longitudinal direction each alternate roller is provided with said braking means.

7. Apparatus in accordance with claim 5, wherein the braking means comprises a helical rib on the cylindrical surface of the roller.

8. Apparatus in accordance with claim 7, wherein the pitch of the helical rib is approximately 5 cm and the height of the rib approximately 0.5 cm.

9. Apparatus in accordance with claim 1, including means to individually adjust the peripheral velocity of at least one of the said rollers.

10. Apparatus in accordance with claim 9 wherein the peripheral velocity of the roller is adjustable from a first velocity to a velocity of approximately 2.5 m/sec.

* * * * *